US005656792A

United States Patent [19]

Rentzsch et al.

[11] Patent Number: 5,656,792

[45] Date of Patent: Aug. 12, 1997

[54] PROJECTILE

[75] Inventors: Max Rentzsch, Schnaittach; Manfred Schildknecht, Eckental-Echenhaid; Hans Strauss, Reichenschwand; Rainer Himmert, Lauf, all of Germany

[73] Assignee: Diehl GmbH & Co., Nürnberg, Germany

[21] Appl. No.: 714,239

[22] Filed: Sep. 16, 1996

[30] Foreign Application Priority Data

Sep. 22, 1995 [DE] Germany ..... 195 35 218.1

[51] Int. Cl.[6] ..... F42B 12/62

[52] U.S. Cl. ..... 102/489; 102/473; 102/490

[58] Field of Search ..... 102/340, 342, 102/351, 357, 308, 473, 476, 489, 517–519, 393, 490

[56] References Cited

U.S. PATENT DOCUMENTS

| | | | |
|---|---|---|---|
| H1235 | 10/1993 | Canaday | 102/517 |
| 555,774 | 3/1896 | Johnson | 102/519 |
| 4,036,141 | 7/1977 | Korr et al. . | |
| 4,063,512 | 12/1977 | Davis | 102/476 |
| 4,580,498 | 4/1986 | Abt et al. | 102/215 |
| 4,706,569 | 11/1987 | Wallow et al. | 102/518 |
| 4,803,928 | 12/1989 | Kramer et al. | 102/476 |
| 5,309,843 | 5/1994 | Rentzsch et al. | 102/476 |

FOREIGN PATENT DOCUMENTS

| | | | |
|---|---|---|---|
| 865939 | 6/1941 | France | 102/489 |
| 2472168 | 6/1981 | France | 102/489 |
| 3544528 C1 | 4/1987 | Germany . | |
| 444885 | 11/1949 | Italy | 102/489 |
| 10470 | 10/1915 | United Kingdom | 102/489 |
| 1605340 | 1/1992 | United Kingdom . | |

*Primary Examiner*—Harold J. Tudor
*Attorney, Agent, or Firm*—Scully, Scott, Murphy & Presser

[57] ABSTRACT

A ballistic projectile including a subcaliber-sized penetrator which is coaxially carried in the casing of the projectile, and in which the penetrator additionally carries an explosive charge. The projectile possesses a proximity fuze at its tip which electrically triggers a penetrator-propellent charge which is arranged in the projectile base and which fills the volume of the projectile base, which accelerates the penetrator through a therebetween arranged propellant base, and in which the penetrator additionally possesses an impact detonator.

10 Claims, 1 Drawing Sheet

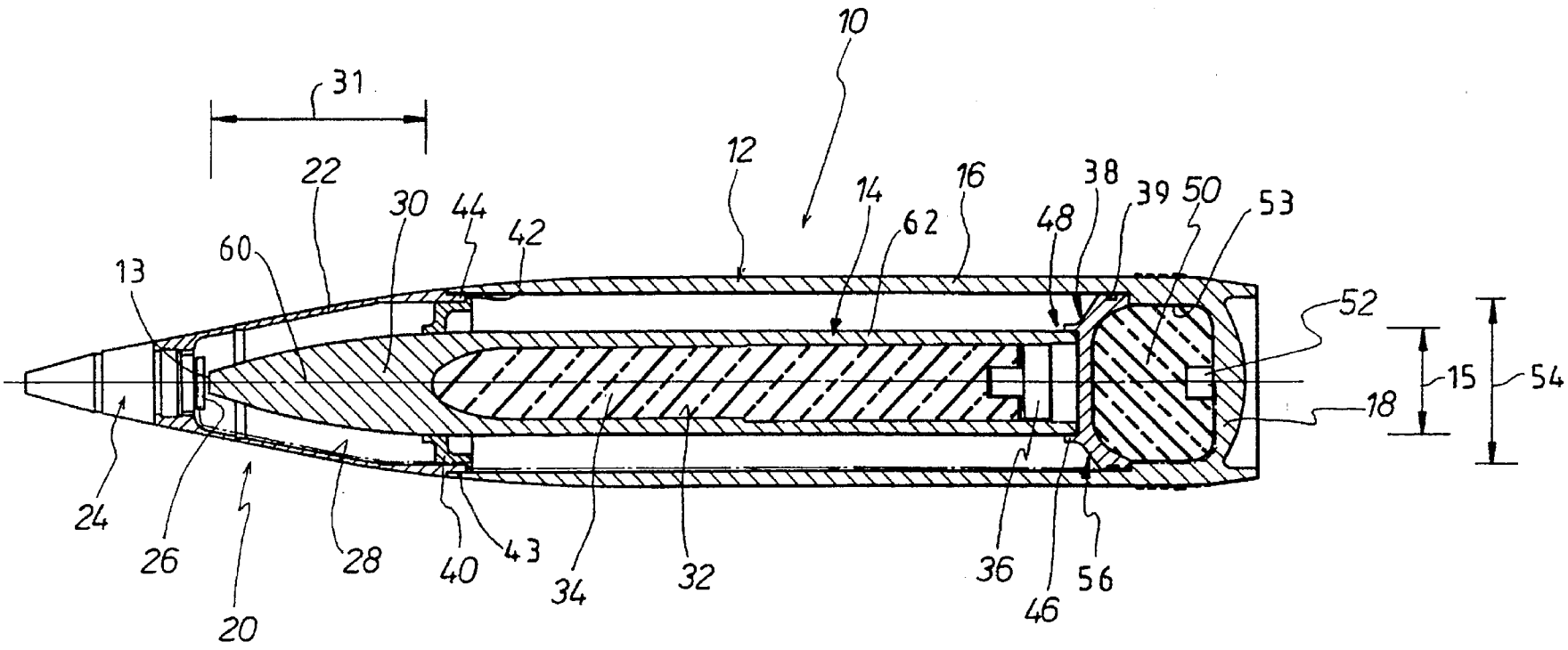
54
15
18
52
53
50
39
38
48
16
62
14
10
12
42
44
30
31
22
60
13
24
26
20
28
40
43
34
32
36
46
56

PROJECTILE

BACKGROUND OF THE INVENTION

1. Field of the Invention

The present invention relates to a ballistic projectile including a subcaliber-sized penetrator which is coaxially carried in the casing of the projectile, and in which the penetrator additionally carries an explosive charge.

2. Discussion of the Prior Art

With currently known projectiles; in essence, with those of known artillery ammunition, for example, of 155 millimeter caliber, bunkers, dugouts, shelters or the like are only unsatisfying or not at all attackable, inasmuch as the penetrating power of the presently employed artillery ammunition, among other circumstances, is too low in concrete. The combination of that type of known projectile with a mechanical impact detonator produces penetration yields in concrete in the magnitude of about one-half meter when the projectile strikes perpendicularly or normally against the target which is to be attacked. At relatively narrow impact or incidence angles of from; for example, a magnitude of 25 degrees, there is obtained not only a corresponding increase in the extent of the penetrating path, but especially the danger of ricochets. Moreover, it is not possible to preclude that the impact detonator of such a known projectile will not be damaged during the penetrating process, so that it either not at all lead to detonation or to a premature detonation of the explosive charge. The functionally relevant components of the impact detonator in such a known projectile are namely only protected in that they are arranged within a fuze orifice of the projectile casing. The detonator or triggering fuze tip itself is in these projectiles not adapted to break concrete.

A bomb in accordance with the disclosure of British Patent No. 1,605,340, for the attacking of concrete targets such as launch pads, possesses a hollow charge for the preboring of the launch pad and an explosive projectile constituting a follower projectile. Provided for the hollow charge is an impact detonator, inasmuch as only thereby is there afforded the orderly generating of the effect of the hollow charge. For the triggering of the propellent charge of the explosive projectile, there is provided a piezoelectric fuze which lies directly against the rear side of the explosive charge of the hollow charge. This triggering sequence is critical, inasmuch as no provision is afforded as to whether the triggering impulse of the piezoelectric fuze is disrupted or destroyed by the explosive impulse of the explosive charge.

The explosive charge of the explosive projectile, in a continuation of the above-described triggering sequence, is triggered through the intermediary of a pyrotechnic delay unit, commencing from the propellent charge. The triggering of the explosive charge of the explosive projectile is therefore relatively imprecise and poorly operationally reliable. A characteristic feature of British Patent 1,605,340 is consequently the sequential triggering, relative to the propellent charge and the explosive charge. The present invention does not utilize this sequential triggering.

In the disclosure of German Patent Specification DE 35 44 528 C1 there is set forth an operational principle which essentially corresponds to that laid down in British Patent No. 1,605,340, namely for an explosive projectile through the intermediary of a hollow charge there is prebored an opening in concrete. The propellent charge is consequently small and corresponds with the caliber of the explosive projectile.

SUMMARY OF THE INVENTION

Accordingly, it is an object of the present invention to provide a projectile of the above-mentioned type, which possesses a considerably improved penetration power in concrete and the like, so as to be suitable for the attacking of bunkers, dugouts, shelters or the like.

The foregoing object is inventively achieved in a projectile of the above-mentioned type in that the projectile possesses a proximity fuze at its tip which electrically triggers a penetrator-propellent charge which is arranged in the projectile base and which fills the volume of the projectile base, which accelerates the penetrator through a therebetween arranged propellent base, and in which the penetrator additionally possesses an impact detonator.

Further advantageous features, embodiments and modifications of the inventive projectile may be readily ascertained from the following detailed description.

The advantages which are achieved by means of the inventive projectile consist of in that it evidences a comparatively good penetrating power in concrete or the like, such that bunkers, dugouts, shelters or the like can be attacked in an optimum manner. Moreover, the inventive projectile possesses an improved functional or operational dependability, meaning, a reduced danger of ricochets through an optimized penetrator contour, as well as affording a dependable triggering function.

The external contour and the mass of the inventive projectile preferably correlate with corresponding values of usual projectiles; in essence, the inventive projectile can be in an advantageous manner be ballistically equivalent with currently employed ammunition, so that there can be assumed the firing tables of currently employed ammunition. This; however, signifies that the firing tables need not be first determined through expensive experiments. Also the stray hitting behavior, for example, such as the target striking accuracy of the inventive projectile can correspond with the target striking accuracy of the currently employed ammunition.

An exemplary embodiment of the inventive projectile is illustrated in the single figure of the accompanying drawing, shown in a longitudinal sectional view at a reduced scale.

DETAILED DESCRIPTION OF A PREFERRED EMBODIMENT

The drawing illustrates a representation of the projectile 10, which incorporated a penetrator 14 within a projectile casing 12 of suitable caliber. The projectile casing 12 consists of a jacket member 16 which is integrally constructed with the projectile base 18, as well as a ballistic projectile hood 22 which defines the tip section 20 of the projectile 10. Arranged on the forward end of the ballistic projectile hood 22 is a proximity fuze 24. The proximity fuze 24 is equipped with an electrical outlet 26 to which there is attached a connector line 28 which can be either an electric connector line or a pyrotechnic connector line, which is illustrated by a dash-dotted line.

The penetrator 14 possess a massive or solid ballistic head 30 with a flattened elliptical or oblete end surface 13 which is bounded by a sharp edge, and a space 32 which connects towards the front to the ballistic head 30, and in which there is located an explosive charge 34. The penetrator 14 possesses a base impact detonator 36 for the triggering of the explosive charge 34. The base impact detonator 36 can be equipped with a pyrotechnic or with an electrical delay device. The latter can possess a variable-time function; in essence, the time function can be presettable to a specified value, or can be settable by means of a suitable acceleration-sensor device.

The length 31 of the head 30 corresponds to 2.3 times the diameter 15 of the penetrator 14. This length 31, in connection with the total mass of the penetrator 14, provides for the necessary penetrating power in concrete.

The penetrator 14 which is constructed in this manner is precisely centrally positioned in the projectile casing 12 by means of a propulsion base 38 with a sealing ring 39 and through a guide ring 40. The guide ring 40 lies by means of a counter-stop which is constructed as an annular flange 42 against an annular stop or shoulder 44 formed in the projectile hood 22. The guide ring 40 is as a result positioned in the projectile casing 23 so as to be axially immovable.

The projectile hood 22 is screwed together with the projectile casing 12 at location 43. The propellant base 38 is formed with an annular collar 46 which serves for positioning in place the rearward end portion 48 of the penetrator 14. The propellant base 38 is arranged so as to be axially movable within the projectile casing 12. The space between the propulsion base 38 and the projectile base 18 of the jacket or casing member 16 of the projectile casing 12 is provided for the receipt of a propellent charge 50. The propellent charge 50 is triggered by means of a propellant charge detonator or fuze 52 which is connected with the electrical connector line 28.

Thus, the inventive projectile 10 consists of the projectile casing 12 with a ballistic projectile hood 22, as well as the subcaliber-sized penetrator 14 which is protectively arranged within the projectile casing 12, and is equipped with the explosive charge 34 and the base-impact detonator 36. The penetrator 14 fixed in position by means of the propellant base 38 and by means of the guide ring 40 in the interior of the projectile casing 12. The penetrator-propellent charge 50 serves for the expulsion of the penetrator 14 from the projectile casing 12. The penetrator propellent charge 50 is triggered or ignited by means of the propellent charge-detonator or fuze 52, which is interconnected by means of the connector line 28 with the proximity fuze 24. The proximity fuze 24 thus serves for initiating the propellant charge detonator or fuze 52.

The projectile casing 12, the penetrator 14 and the propulsion base 38, due to the high loads and stresses encountered during firing; or respectively, upon the expulsion of the penetrator 14 from the projectile casing 12, are expediently constituted of high-strength steel; for example, such as find application for highly-stressed or loaded components in other kinds of ammunition.

The ballistic projectile hood 22, or respectively, its forward portion, as well as the proximity fuze 24 can be pierced through by the penetrator 14, however, it is also possible to blow off the mentioned forward portion of the ballistic projectile hood 22 and the proximity fuze 24 in parallel with the triggering of the propellent charge 50.

A space 53 for a penetrator-propellent charge 50 possesses a diameter 54, which corresponds to 1.5 times the size of the diameter 15 of the penetrator 14.

The propulsion base 38 is concavely formed in the direction towards the penetrator-propellent charge 50, and with its curved flange 56 towards the projectile base serves, on the one hand, as a cover for the space 53 and, on the other hand, a propulsion disk for the penetrator 14.

The concave form of the propellant base 38 also serves to win an additional amount of space for the space 53 and evidences an expedient stress distribution during the support of the entire projectile 10 during firing, as well as during the expulsion of the penetrator 14 from the projectile casing 12.

Due to the ratio between the diameters 54 and 15, the penetrator 14 is a subcaliber-sized inertial projectile with a high starting velocity, linear or flat trajectory and with a high penetrating power.

The concave flange 56 increases the guided length of the penetrator 14 within the projectile casing 12, so that the penetrator 14 exits coaxially from the projectile casing 12; in effect, does not evidence any, or at most only a slight starting angle.

The sharp-edged end surface. 13 of the head 30 ensures that the penetrator 14 when also at striking against the concrete at an angle which is <90° will penetrate into the concrete.

The function of the projectile is as follows:

After the firing of the projectile 10 from a launch tube or weapon barrel (not shown), the proximity fuze 24 senses a target constituted of concrete, and at a suitable distance from the target triggers the propellent charge detonator 52.

The gases of the penetrator-propellent charge 50 drive the propellant base 38 together with the penetrator 14, whereby the penetrator 14 is radially guided by the collar 46 and the guide ring 40.

The penetrator 14 pierces through the proximity fuze 24 and the projectile hood 22. Thereafter, the propellant base 38 strikes against the guide ring 40 and the penetrator 14 leaves the propellant base 38 and the guide ring 40.

Upon striking against the target, the time-delayed triggering function of the base impact detonator 36 is set into motion. Through the high energy of the penetrator 14, the latter penetrates through the target. Subsequent to the penetrating sequence, the base impact detonator 36 triggers the explosive charge 34, as a result of which the head 30 and the casing 62 of the penetrator 14 are disintegrated into fragment.

The inventive ballistic projectile 10 is reliable in its functioning. It possesses only a single component which acts in the target; namely, the penetrator 14. The penetrator-propellent charge 50 is large in volume and is functionally-dependably triggered by the proximity fuze 24. The penetrator 14, primarily due to its massive or solid head 30, possesses the required mass for piercing through the target.

What is claimed is:

1. A ballistic projectile including a subcaliber-sized penetrator; a casing of said projectile coaxially guiding said penetrator therein, said penetrator totally contained within said casing; said penetrator carrying an explosive charge; a proximity fuse located at the tip of said projectile; a propellent charge for said penetrator being arranged in a base of said projectile and filling the volume of said projectile base; connector means for causing said penetrator propellent charge to be triggered by said proximity fuse, wherein said penetrator propellent charge accelerates the penetrator through a propulsion base arranged therebetween; said propulsion base being axially moveable and having a collar projecting radially outwardly of a diameter of the penetrator, the propulsion base covering said propellant charge, the diameter of the propellant charge being greater than the diameter of the penetrator; said penetrator further incorporates a base impact detonator; a forwardly located penetrator guide ring axially immovably contacting stop means formed in the projectile casing, the penetrator being axially movably guided in the projectile casing by said propulsion base and by said guide ring which is spaced therefrom, said propellent charge being arranged between the projectile base and the propulsion base.

2. A ballistic projectile as claimed in claim 1, wherein the penetrator includes a solid ballistic head having a length which corresponds to about 2 to 5 times the diameter of the penetrator.

3. A ballistic projectile as claimed in claim 1, wherein a space in said projectile for the penetrator propellent charge possesses a diameter which corresponds to about 1.2 to 2.5 times the diameter of the penetrator.

4. A ballistic projectile as claimed in claim 1, wherein the propulsion base is plate-shaped and includes a flange projecting radially outwardly of the diameter of the penetrator and being curved towards the base of the projectile, and wherein the propulsion base closes the space in the form of a cover for the penetrator propellent charge.

5. A ballistic projectile as claimed in claim 1, wherein the base impact detonator includes pyrotechnic delay means.

6. A ballistic projectile as claimed in claim 1, wherein the base impact detonator includes electrical delay means.

7. A ballistic projectile as claimed in claim 1, wherein the base impact detonator possesses a variable time function.

8. A ballistic projectile as claimed in claim 1, wherein the base impact detonator possesses a time function which is settable through acceleration sensor means.

9. A ballistic projectile as claimed in claim 1, wherein said connector means comprises a pyrotechnic connector line.

10. A ballistic projectile as claimed in claim 1, wherein said connector means comprises an electrical connector line.

* * * * *